US007115071B1

(12) United States Patent
Sunbeck

(10) Patent No.: US 7,115,071 B1
(45) Date of Patent: Oct. 3, 2006

(54) "FIGURE-EIGHT" TRACK, APPARATUS AND METHOD FOR SENSORY-MOTOR EXERCISE

(76) Inventor: Deborah T. Sunbeck, 151 Panorama Trail, Rochester, NY (US) 14625-1843

( * ) Notice: Subject to any disclaimer, the term of this patent is extended or adjusted under 35 U.S.C. 154(b) by 305 days.

(21) Appl. No.: 10/223,444

(22) Filed: Aug. 20, 2002

(51) Int. Cl.
*A63B 71/00* (2006.01)

(52) U.S. Cl. ..... 482/8; 482/75; 482/148; 21/668

(58) Field of Classification Search ..... 482/8, 482/148, 75; D21/668
See application file for complete search history.

(56) References Cited

U.S. PATENT DOCUMENTS

| | | | | |
|---|---|---|---|---|
| 4,121,821 | A | 10/1978 | Graham | |
| 4,236,697 | A * | 12/1980 | Savino | 256/1 |
| 4,423,871 | A * | 1/1984 | Mucaro | 463/64 |
| 4,549,732 | A * | 10/1985 | Hoffman | 482/51 |
| 4,907,571 | A | 3/1990 | Futakami | |
| 4,973,044 | A | 11/1990 | Jones | |
| 4,988,092 | A * | 1/1991 | Trout | 482/51 |
| 5,066,000 | A | 11/1991 | Dolan | |
| 5,232,154 | A | 8/1993 | Jenkins et al. | |
| 5,800,272 | A * | 9/1998 | Pons | 472/85 |
| 5,924,960 | A | 7/1999 | Cohen | |
| 6,354,223 | B1 * | 3/2002 | McKoy | 104/72 |
| 2001/0018370 | A1 * | 8/2001 | Arie | 472/43 |

OTHER PUBLICATIONS

Sunbeck, Deborah T., Infinity Walk: Preparing Your Mind to Learn, 1991, Infinity Press, Rochester, New York.
Sunbeck, Deborah T., Infinity Walk: Preparing Your Mind to Learn, 1996, Jalmar Press, Torrance, California.

* cited by examiner

*Primary Examiner*—Lori Amerson
(74) *Attorney, Agent, or Firm*—James Creighton Wray

(57) ABSTRACT

A track for cognitive and physical training has a figure-eight surface with both or alternate inner and outer borders. Adjustable weight-bearing rails inside and outside the track assist rehabilitation. Gates in outer rails admit users to the track. Oppositely swinging gates at a center of track between the two loops provide supported direction from one track loop to another. Coordinated walking with bodily rotation and turning is promoted by a single off track focus point in a plane through the center separating the two loops. Increased motor, sensory, cognitive and other challenges are added to the walking, turning and lateral rotation.

62 Claims, 13 Drawing Sheets

2
2
20
31
9
10
5
4
21
10
N
22

1
32
1
33

"FIGURE-EIGHT" TRACK, APPARATUS AND METHOD FOR SENSORY-MOTOR EXERCISE

BACKGROUND OF THE INVENTION

Many walkers and stationary parallel bars have been used to aid exercise rehabilitation for persons recovering from physical trauma including injury or stroke.

Needs exist for improved stationary guides for rehabilitation that provide greater rehabilitative integration of motor, sensory and cognitive functions.

SUMMARY OF THE INVENTION

The invention resides in the figure-eight track or supportive rail device. Figure-eight walking had been described in publications by the inventor, but no actual track or guide had been created.

The basic starting method is to walk in a continuous figure-eight pattern using fixed and gated guides. The figure-eight has two mirror-imaged, generally circular or oval paths.

The method next adds any combination of motor, sensory, focused attention, perceptual, rhythmic, communication, or cognitive complexity to the figure-eight continuous walking; and, in any reasonable order. The method requires that each additional complexity should not significantly reduce the quality of pre-established competence in previous complexities, beyond a reasonable practice period. Thus, the method builds on past successes in the use of the body, in incremental steps that are broken down in complexity, so as to promote frequent successes and advancement to new levels and areas of personal challenge.

Each of the method's added complexities are equally challenged by walking along the guiding rails in both clockwise and counterclockwise directions and in generally circular walking paths which form the guided figure-eight course. As the challenges progress, the method uses the precise placement of visual, auditory, natural, human, and other stimuli at any point directly outward from the mid-line of the figure-eight course. The mid-line is determined by an imaginary line where two 90° angles would meet if measured from a second mid-line through the longest length of the figure-eight walking guides. This "point of sensory focus", be it near or far, works with the symmetry of the mirror-image figure-eight walking track or rails to allow for a balanced bilateral training of basic motor reflexes such as neck turning and eye tracking, torso rotation around the spine, arm swing, balanced use of body, and proper gaiting. It further challenges sustained sensory, perceptual and cognitive attention, and the practice of multi-tasking of all of the above.

The method is presented as a non-competitive but personally challenging form of play, in the spirit of a game of "How Many Things Can You Do At Once?" The method, thus, is suitable for both therapeutic and recreational purposes.

The present invention is a therapeutic, exercise and recreational "figure-eight" track with assistive apparatus and method for ambulation and sensory-motor integration practice.

A flat continuous figure-eight track has two mirror-imaged generally circular surfaces. Optional adjustable and removable generally parallel rail supports or laterally confining structures or boundaries, are mounted to or otherwise follow the pathway of the continuous track. The rail has a plurality of sections; the use of each component piece being determined by the immediate application needs.

In every application, the most basic practice of the associated method is continuous assisted or unassisted locomotion, by some weight-bearing means, around the figure-eight track or surface. The method's initial motor and sensory value for the user is derived from the use of the track's constant figure-eight curving. That causes the physical body of the user to alternate direction of lateral rotation between the track's clockwise and counterclockwise mirror-imaged halves. Therefore, all applications use the smallest and most circular track dimensions that are reasonable for the chosen means of locomotion. Once the user reaches success in continuous locomoting around the figure-eight track, additional physical challenges are selected, added and practiced in a self-paced manner. One of the most important of the next challenges is the holding of a precisely derived visual target throughout the continuous movement along the figure-eight configured track. That allows for the greatest bilateral rotation of, but not limited to, eye tracking, neck turning, and lateral torso rotation.

When the use of the new track is for the therapeutic practice of walking, additional optional modular supports of two, three or four configured hand rails are used in conjunction which the eight configured surface or track. The optional horizontal support bars have two inner and two outer generally circular handrails, which allow for passage between the two mirror-imaged halves of the track. The adjustable and removable horizontal support bars can accommodate adult and child use, and single or parallel bar applications. For example, therapist-assisted use may be aided by the removal of one support rail to provide better proximity of the therapist to the patent; especially in the case of stroke rehabilitation. Applications for other types of laterally confining structures provide spatial cues rather than weight-bearing support, confine or contain certain activities within the dimensions of the figure-eight surface, or define the boundaries of the track for the user.

The figure-eight track may be transversed on foot, with the use of a wheeled vehicle, on therapeutic horseback, or by any other means of weight-bearing locomotion. Wheeled vehicles include but are not limited to: bicycles, roller skates, children's ride-on toy vehicles, motorized wheel chairs and other motorized transportation devices, and wheelchairs and baby carriages being pushed or otherwise manually operated. Locomotion on foot includes but is not limited to walking, jogging, and running and assisted therapeutic practice walking.

These and further and other objects and features of the invention are apparent in the disclosure, which includes the above and ongoing written specification, with the claims and the drawings.

DETAILED DESCRIPTION OF THE PREFERRED EMBODIMENTS

Figure 1A:
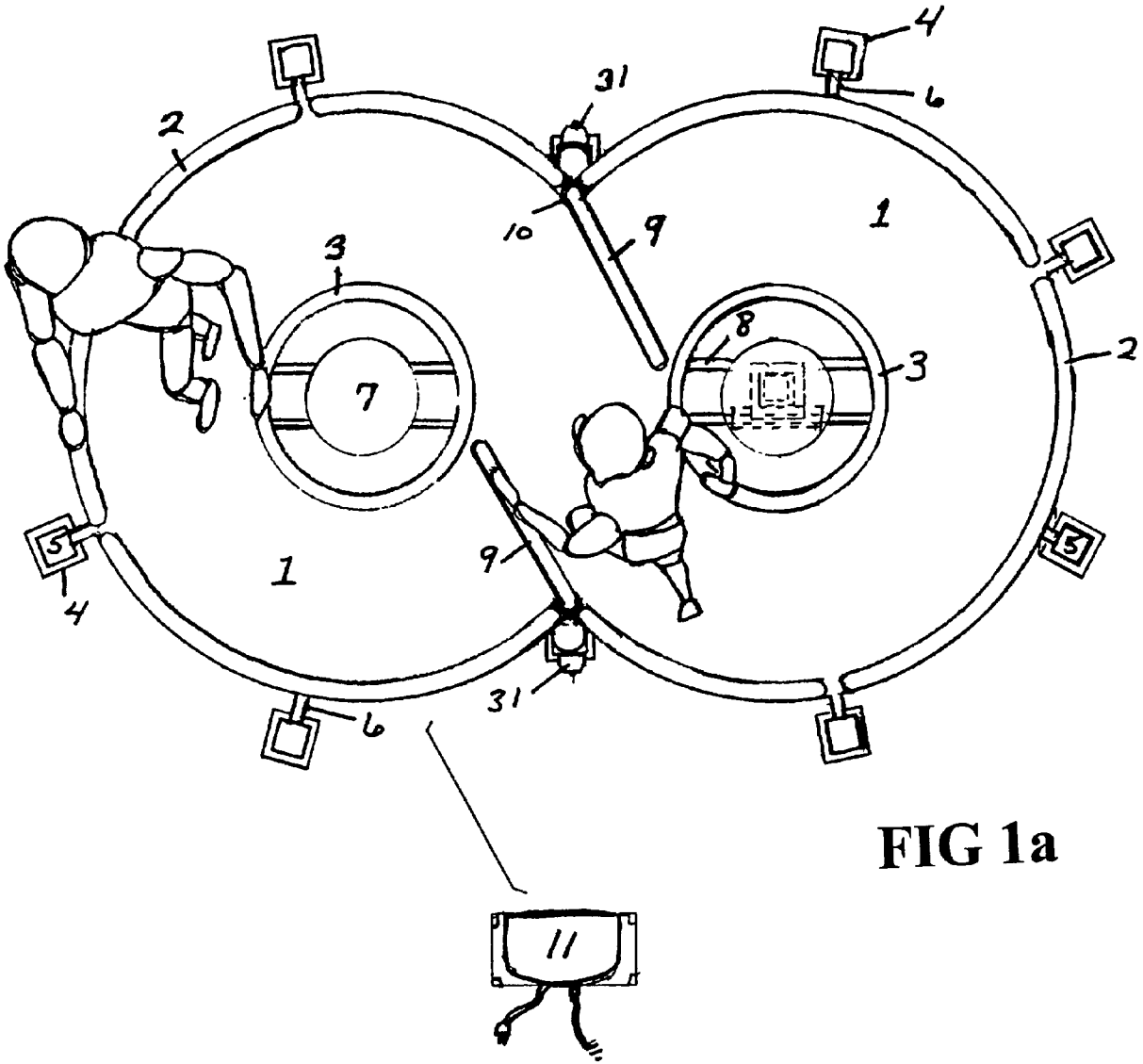
FIG. 1*a* is a top view showing a therapeutic and exercise ambulation application of the present invention.

FIG. 1*a* shows a therapeutic and exercise ambulation application of the invention, which includes assistive weight-bearing supports along outer and inner laterally defining boundaries 2, 3 of the generally figure-eight configured track 1. The track or surface is a continuous figure-eight pathway configured as two mirror-image generally circular halves.

Figure 1B:
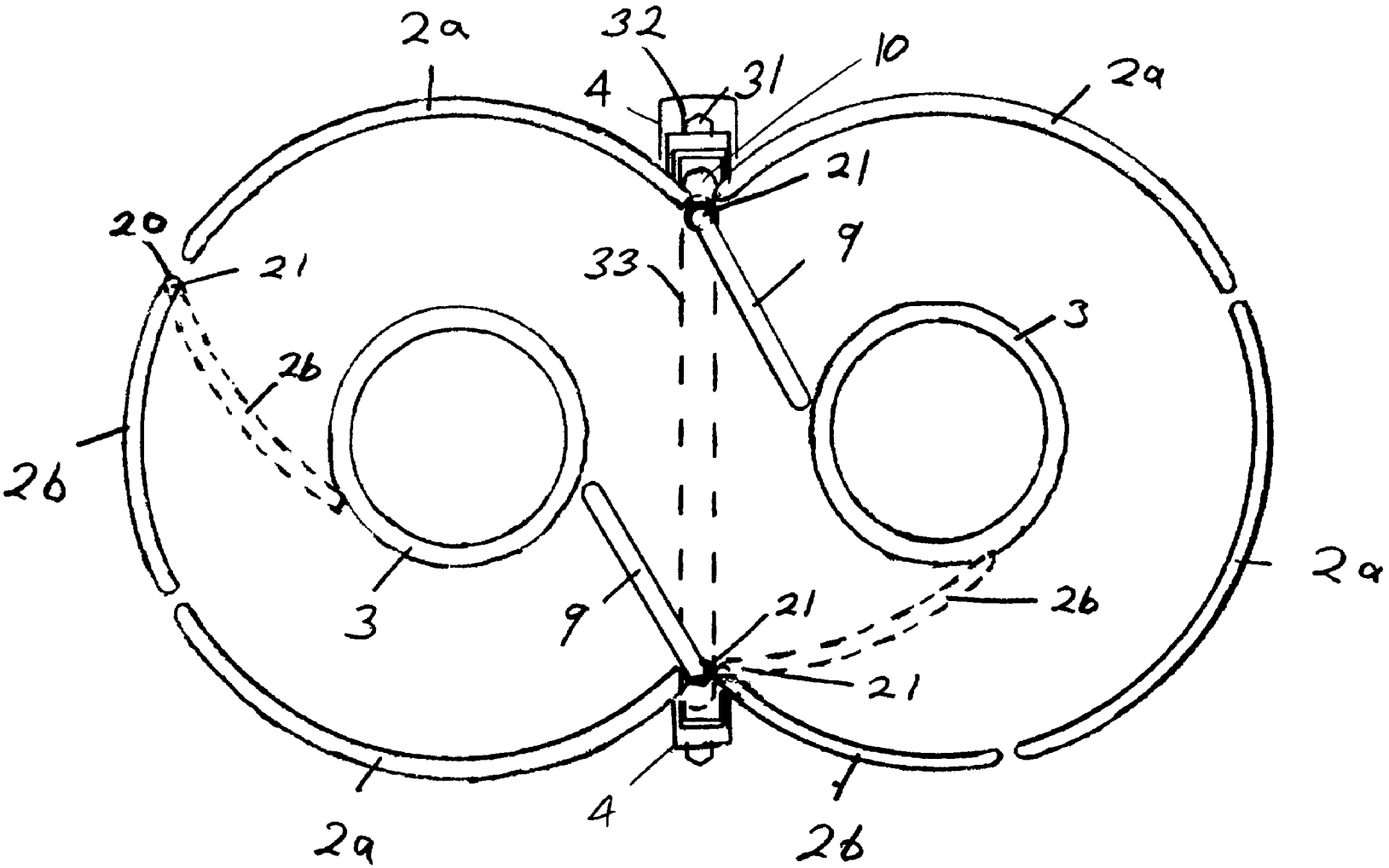
FIG. 1*b* is the top view shown in FIG. 1*a*, detailing two options for outer rail gate locations.

FIG. 1*a* shows an outer generally circular weight-bearing support rail 2, as it would be used for assistive ambulation applications. The track can have a variety of suitable laterally confining structures or boundaries. The outer support bars 2 include sections of hinged or removable rail, which allow entrance and exit to and from the enclosed track. The hinged or removable sections are located at any point around the circuitous outer rail. The outer rails 2, when configured to enclose the entire figure-eight track, have four longer rail sections 2*a* of equal length (FIG. 1*b*). Two shorter hinged or removable gate rail sections 2*b* can be located anywhere along the outer rail structure 2, so as to provide the most convenient entrance and exit locations when in use.

The inner generally circular weight-bearing support rails 3 are used for assistive ambulation applications, but otherwise can be comprised of a variety of suitable laterally confining structures or boundaries. The figure-eight configured track 1 may be made of materials such as, but not limited to, resilient flooring or a rubberized surface. The assistive support devices 2, 3 may be used separately and secured directly to the available flooring surface.

The distance between the outer and inner generally circular weight-bearing support rails 2, 3 or otherwise laterally confining structures or boundaries will vary with application. FIG. 1*a* shows an assisted ambulation application which might be used therapeutically for, but is not limited to, rehabilitation or exercise for the disabled or the elderly. In this application the width of the walking course 1 is sufficient to allow for the generally parallel support rails 2, 3 along the inner and outer laterally confining structures to be reachable by both hands simultaneously, or requiring no more than one step to reach from one of the two inner support rails 3 to the other inner circular rail 3.

Figure 6:
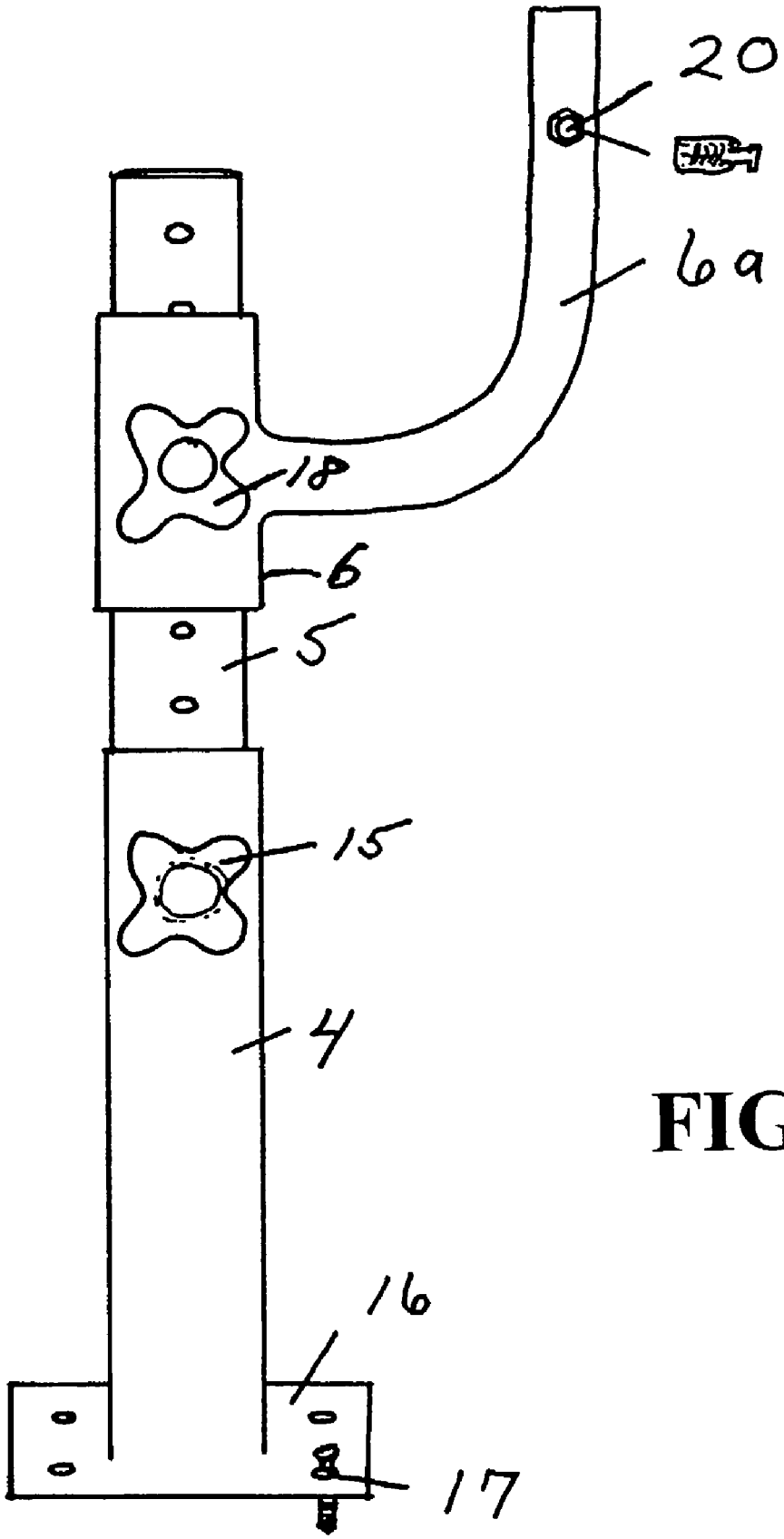
FIG. 6 is a side view showing the single rail support configuration for the outer generally circular weight-bearing support.

As shown in FIG. 6, surface mounted support columns 4 act as outer sleeves for somewhat more narrow height adjustable columns 5, which slide vertically inside the surface mounted support columns 4. Upper vertically sliding collars 6 that fit over adjustable columns 5 provide second height adjustment sources for further fine-tuning of the support height to an individual user's needs. Upward curving tube extensions of the sliding collars 6 are used to secure the outer generally curving weight-bearing support rails 2 to the vertical sliding collars 6.

Figure 3:
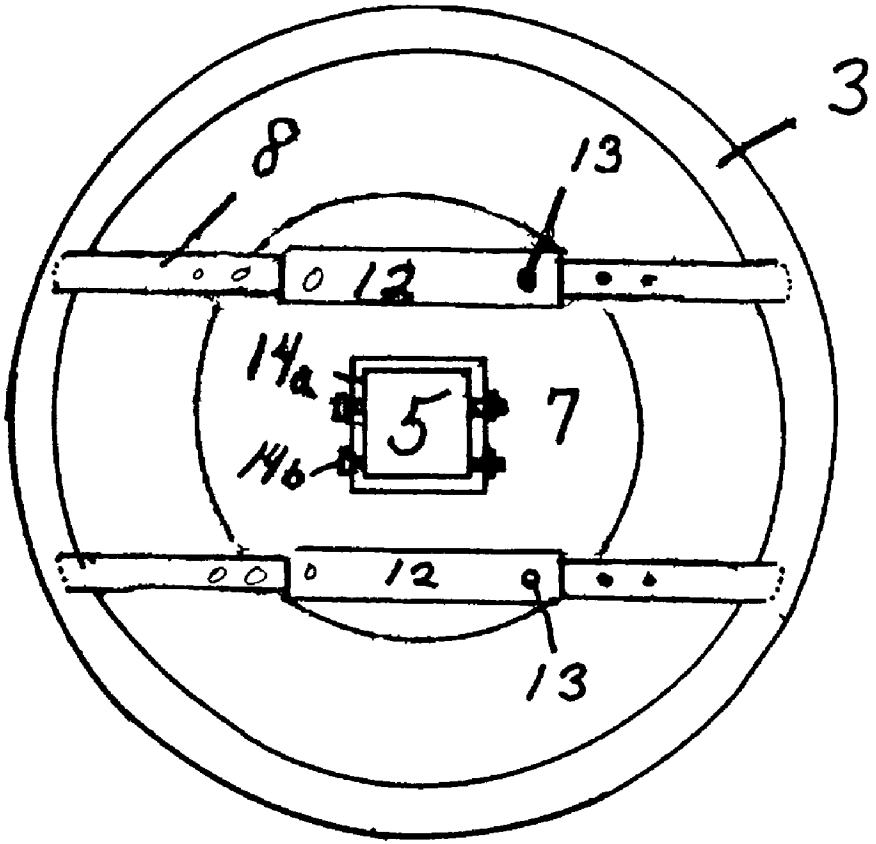
FIG. 3 is a bottom view of the inner circular weight-bearing support rail.
Figure 4:
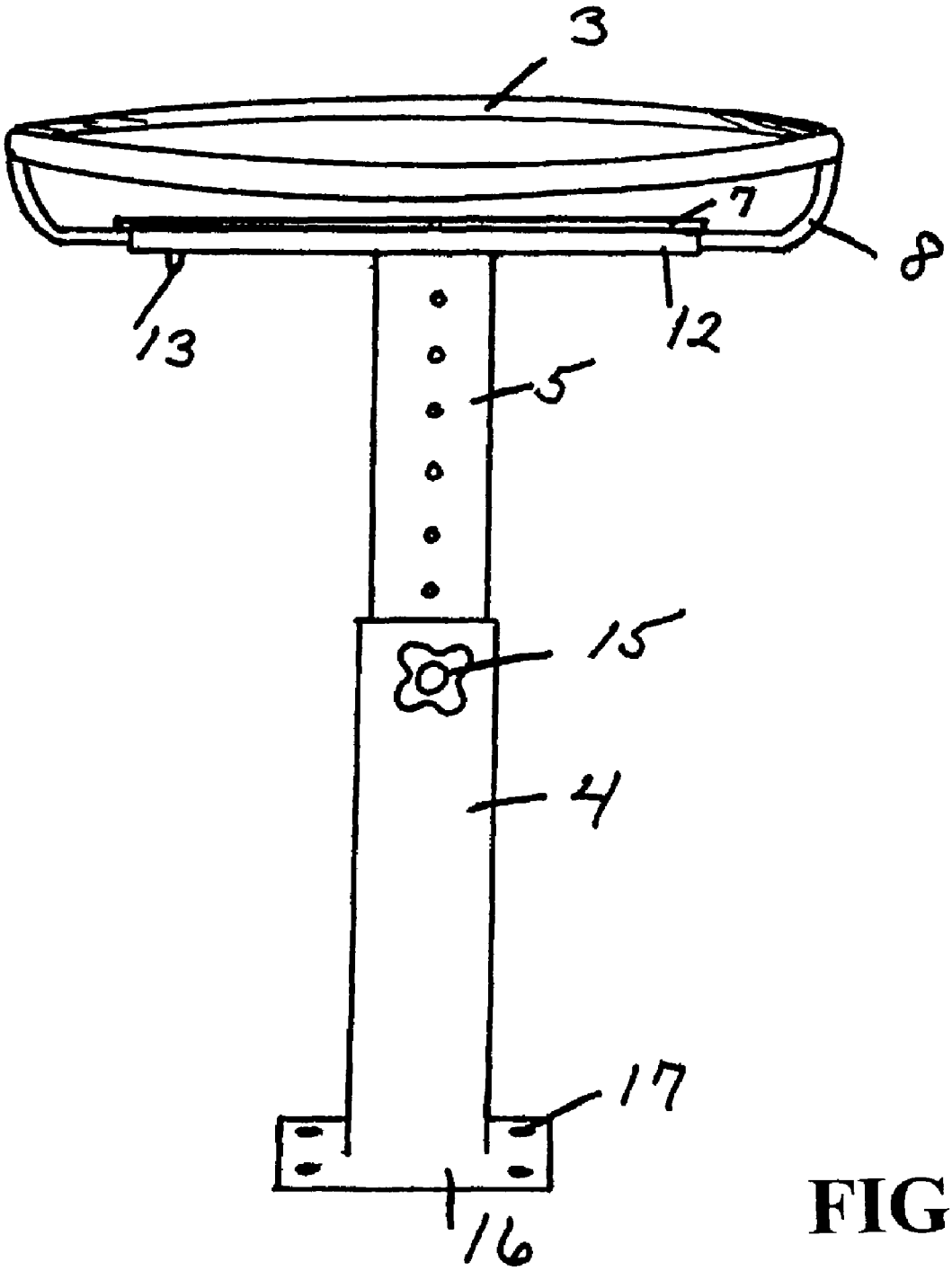
FIG. 4 is a side view of the inner generally circular weight-bearing support and the adjustable height column.

As shown in FIGS. 3 and 4, the inner generally circular support rails 3 use a somewhat different support configuration. Surface-mounted support columns 4 act as outer sleeves for somewhat more narrow height adjustable columns 5, which slide vertically inside the surface mounted support columns 4. The tops of the vertical support columns 5 are fastened to the undersides of the top plates 7. Columns 5 fit into collars 14*a* welded to the undersides of plates 7, and the columns are secured to the collars 14*a* with two or more sets of bolts 14*b* and nuts or other type fasteners.

The vertical height adjustments to the outer and inner weight-bearing generally parallel support rails 2, 3 give stability and mobility support within a height range from cane or walker to crutch-height, with the option of using equal or unequal heights between the inner and outer support rails. Variations in the lengths of component base columns 4 and adjustable support columns 5 used during fabrication provide for a full range of height applications from very early childhood needs to the tallest of adult height applications.

Width adjustable horizontally mounted supports 8 attach to the inner weight-bearing generally circular support bars 3, so as to give stability and mobility support to the invalid user. That allows for either simultaneous or one-step-away use of both of the inner support rails 3. Optional width-adjustable vertically sliding collars 6 attached to the outer rails 2 provide further range of track width. Variations in the overall dimensions of the components, including but not limited to the dimension of the track surface, the rails lengths and diameters, during fabrication provide for a full range of applications from very early childhood needs to the tallest of adult height applications.

An optional and quickly removable identical pair of swinging weight-bearing supports 9 rotate inside a vertical column 10 that is attached to the inner lateral plane of the two center support columns. The lengths of the swinging supports 9 create arcs that allows the invalid user to continue along the entire continuous track without interruption of bilateral weight-bearing support. The arcing rotation of the swinging supports 9 is accomplished through either manual devices 21 or 22, or a reversible motor driven belt apparatus 32. The motorized belt 33 fits under a slightly raised figure-eight track and engages both swing arms 9 simultaneously (FIG. 1*b*) thereby opening and shutting the two swinging supports 9 in unison through the use of a switch 31 installed on both center support columns that hold the swinging rail extensions 9. The swinging rail extensions 9 are easily removed by the therapist as soon as rehabilitation progresses to a point where rail releasing and hand reaching by the user while stepping out is safe for the user and it is of additional therapeutic value to do so. Removal is accomplished by lifting the swinging bar extension 9 directly up and out of the vertical housings 10.

FIG. 1*b* shows two options for outer rail 2 gate 2*b* locations and the option for an inward swinging gate 2*b* controlled by an adjustable locking hub 21 with rotary bearing that provides positive locking at 10° increments of swing. A simpler means to entering and exiting through the gate without need for a control mechanism is to release spring-loaded locking pins 20 (FIGS. 6 and 8) and lift the gate 2*b* up and off the vertical support collars 6. The gate also can be lifted up and off in this same manner with the use of the locking hub option 21. As the user progresses in ambulation, and in applications that do not require containment of the user, the gate may be removed from the outer rail configuration, so as to leave an open passage into and out of the figure-eight track.

FIG. 1*b* shows the two optional swinging supports 9 controlled by a manual adjustable locking hub 21 with rotary bearing that provides positive locking at 10° increments of swing. FIG. 1*b* also shows a motorized option for controlling the rotation of the swinging rail supports 9. A reversible motor 32 drives belt 33 in therapeutic applications when the user is more dependent on the parallel rails. The motor driven belt 33 is housed under a slightly raised track with tapered edges, so as to engage downward extending columns of the swing bars 9 and rotate these downward extending columns in either clockwise or counterclockwise directions inside the vertical housings 10 welded to the support base 4, rather than to the upper adjustable collar 6, as is done in manual applications of the swing arm 9. The motorized device is controlled by switches 31 placed on motor 32 or on the two center support posts 5. The switches 31 may be placed on support posts 5 other than the center support columns 5 to allow the user to activate the gates 9 before reaching them. The wiring to connect the switches 31 to the motor 32 is placed under the slightly raised track to allow for any user-required location of the switches 31.

The reversible motor belt-driven device is capable of simultaneously swinging the two rotating arms 9 clockwise and counterclockwise by belt 33.

The related method trains the user to progress towards walking the continuous figure-eight path while attempting to look towards a specifically calculated "point of sensory focus". The point for visual and auditory focus is represented in FIG. 1*a* as a television 11, but it could be any natural, object, electronic or human stimulus. The method of locomotion around the symmetrically configured figure-eight course equally trains the lateral halves of the user's body. The method further trains bilateral motor reflexes such as neck turning and eye tracking, full range of torso rotation, and visual and auditory sensory attention towards the designated point of sensory focus, and more. The method further integrates motor skill building with sensory attention development, and establishes a basic sensory-motor skill foundation for adding other multi-tasking skills to the method, such as, but not limited to, gaiting, communication (listening and speaking), and cognitive skills. The user practices various multi-tasking skills while maintaining or improving coordinated locomotion around the continuous course. As the user's skill level progresses, new skills are added to the previously successful multi-tasking, while continuing to move around the generally figure-eight course and holding attention on or towards the point in space represented by the television 11 in FIG. 1*a* and the person 34 on a park bench 35 in FIG. 14. The sensory stimulus may be placed anywhere along a near to far linear plane, or an up or down linear plane, but must be located directly outwardly from the midline of the figure-eight configuration, so as to be viewed at any point on a line that might cut the mirror-imaged figure-eight track into two identical circular halves. One illustration of an example of a properly placed point of sensory focus is the location of the park bench 35 seen in FIG. 14.

The minimum usage of the method requires that some form of ambulation or locomotion occurs continuously for some length of time that is therapeutic, recreational, or otherwise beneficial to the user and that the activity is carried out in such a manner as to follow along a track or surface that is configured as a flat figure-eight surface with mirror-imaged halves, so as to provide the user with bilaterally symmetrical usage of both lateral halves of the body. The method further provides the user with increased bilaterally symmetrical usage of both lateral halves of the body by adding a sensory focal point that is exact in its placement so as to maximize bilateral rotation of the entire body, including, but not limited to eye tracking, neck and ear turning, and torso rotation.

The method is best carried out through the mirror-imaged clockwise and counterclockwise circling of the continuous figure-eight configuration, and therefore uses the smallest and most circular flat surface areas that are reasonable for each application. For ambulation by foot the smallest reasonable track would allow the most physically fit of users to complete one entire figure-eight circuit in no less than thirteen steps. This limitation to size prevents over rotation of the knee joints during continuous circling. The upper limits of the figure-eight track is determined by usage, with biking applications, as one example, requiring a larger track than walking applications. For all applications, the benefits of the method are greater when lateral rotation of the head or body is oriented towards the designated point 11 of sensory focus. Therefore, even in larger area outdoor applications of the invention, the figure-eight track configuration is not unreasonably elongated so to cause too much time spent in linear locomotion; nor is the figure-eight configuration necessarily comprised of overly round circular paths, since the increase in roundness in larger area use forces an over rotation of the entire body to hold the user's vision on the designated sensory stimuli 11. In general, the larger the figure-eight track configuration, the less round and the more laterally oval the clockwise and counterclockwise halves of the figure-eight configured track or surface will be, without becoming so elongated as to not be useful within the purpose of the method.

Figure 2:
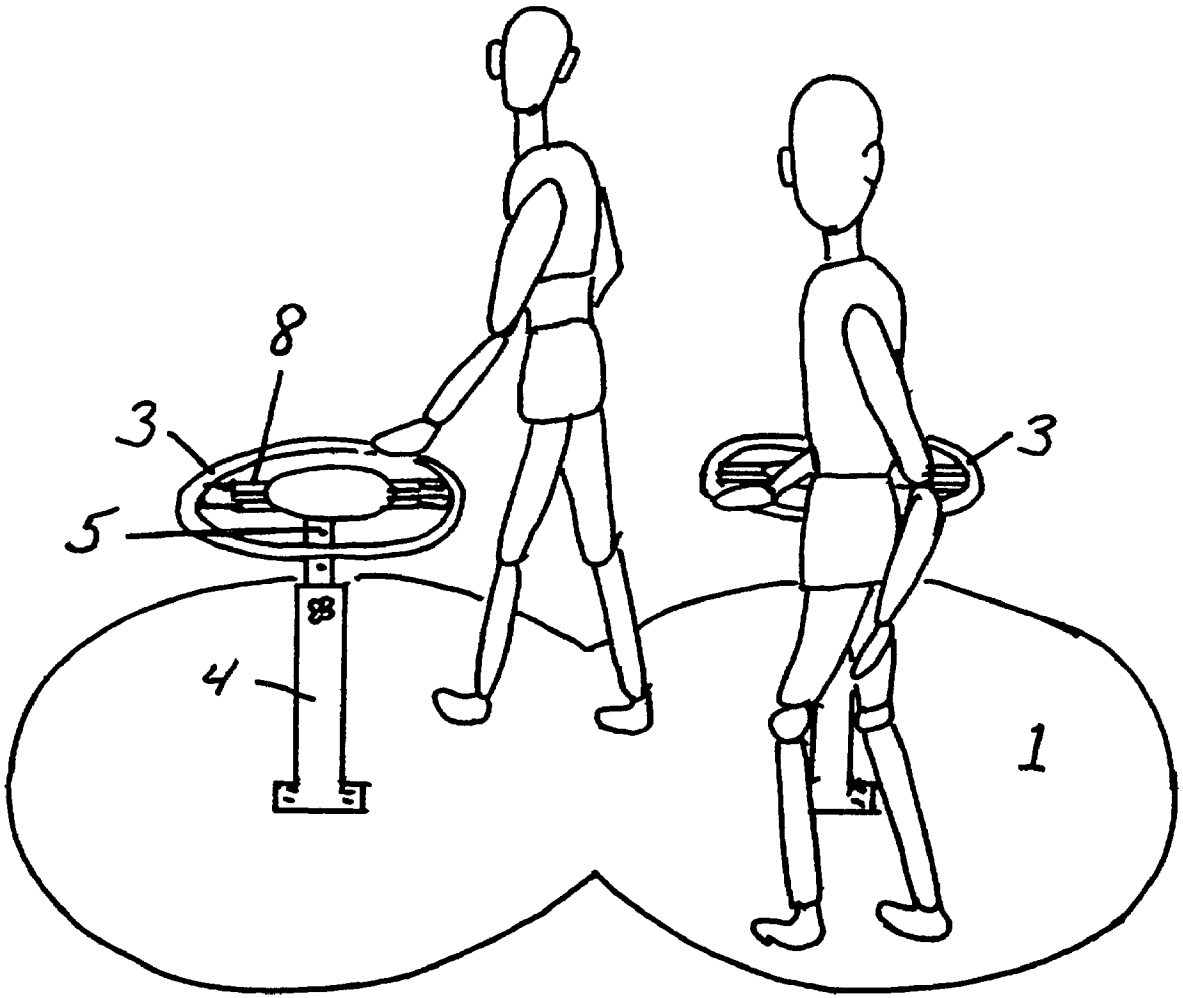
FIG. 2 is a side view of the invention using a continuous track with two inner generally circular weight-bearing support rails.

FIG. 2 shows an application of the invention that uses the continuous track 1 with just the two inner generally circular weight-bearing support rails 3. Other laterally confining or supportive structures could be used. FIG. 2 shows an assisted ambulation application which might be used therapeutically for purposes such as, but not limited to, rehabilitation or exercise for the disabled, the convalescing, or the generally weakened aging user who might benefit from continuous light touch support and periodic weight-bearing support for either lateral side of the body. In this application, the width of the walking course, especially as it passes through center of the figure-eight configuration, is such as to allow the user to engage the second generally circular support rail 3 within one or two steps of releasing the first one. The application of the invention shown in FIG. 2 is for users who do not require the simultaneous bilateral support of parallel bars, and can benefit from alternately left and right sided light touch or weight-bearing support, which occurs as the ambulation shifts between a clockwise and counterclockwise direction while locomoting along the entire figure-eight course.

FIG. 3 shows the underside of the inner circular weight-bearing support rail 3 and its attachment to width-adjustable laterally sliding channel bars 8. The sliding bars 8 move laterally through two somewhat larger channel bars 12. The sliding bars 8 are secured in the channel bars 12 by hand-retractable spring-loaded plungers 13. A number of other types of fasteners with quick release could also be used. The two larger channel bars 12, through which the smaller channel bars 8 slide, are attached to a top plate 7 by welding or other durable attachment of one to the other. The top of the vertical support post 5 is fastened to the underside of the top plate 7 by bolts and nuts 14*b* that secure column 5 to a collar 14*a* welded to the underside of plate 7. Other forms of attachment are possible.

FIG. 4 shows a lateral view of the inner generally circular weight-bearing support 3 and the adjustable height column 5, which slides inside a somewhat larger vertical column 4 and is secured in place by a clamping knob 15 or some other means of secure fastening. The entire vertical support column is mounted on a floor plate 16, which is fastened to the figure-eight surface or track with four or more bolts 17 or other removable fasteners.

Figure 5:
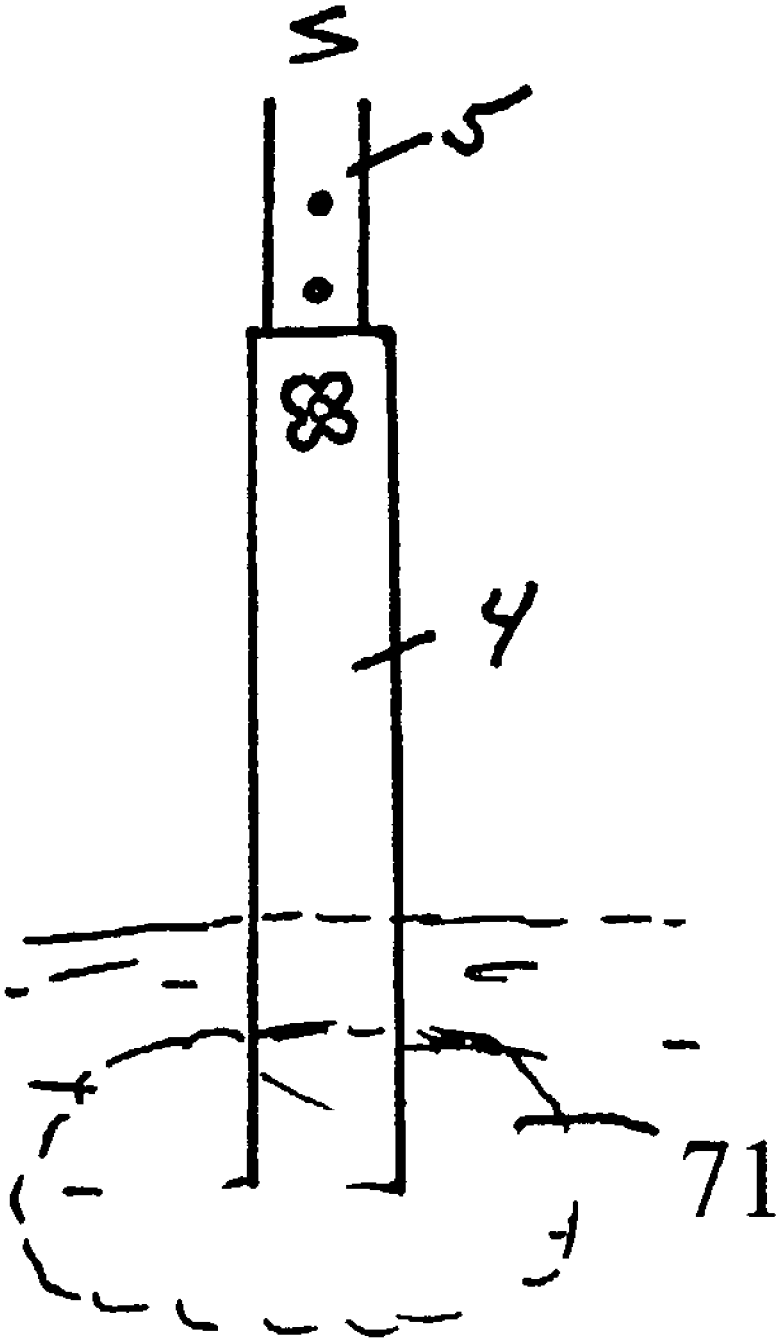
FIG. 5 is a side view of an outdoor installation option to secure the larger vertical base column.

FIG. 5 shows an outdoor installation option to secure the larger vertical base column 4 directly into the ground by means of digging a hole and setting the vertical base 4 in concrete 71. The inner vertical sliding column 5 and attached upper apparatus can be detached seasonally or stored as needed.

FIG. 6 shows the single rail support configuration for the outer generally circular weight-bearing support 2. An upper vertically sliding sleeve 6 provides a second height adjustment source for further fine-tuning of the support height to an individual user's needs. A clamping knob 18 secures the vertical sleeve in place on the sliding column 5.

An upward curving bar 6*a* extending from the sliding sleeve 6 secures the outer generally curving weight-bearing supports 2 to the vertical sliding sleeve 6 by means of bolts and wing nuts 19 or other form of removable fastener placed through aligned holes drilled through the entire width of bars 6*a* and 6*b*, so the downward extensions 73 of outer rails 2 to mount them on the vertically sliding sleeves 6*a* and 6*b*. Spring loaded locking pins permanently installed inside the tubing of the downward extensions 73 directly in line with the holes 20 in the upper curving bars of 6*a* and 6*b* may also be used to secure the outer rails 2 to the support column vertically sliding sleeves 6, while providing quick release. The single rail supports are used for additional support at the midpoint of the longer outer rail sections 2*a*.

Figure 7:
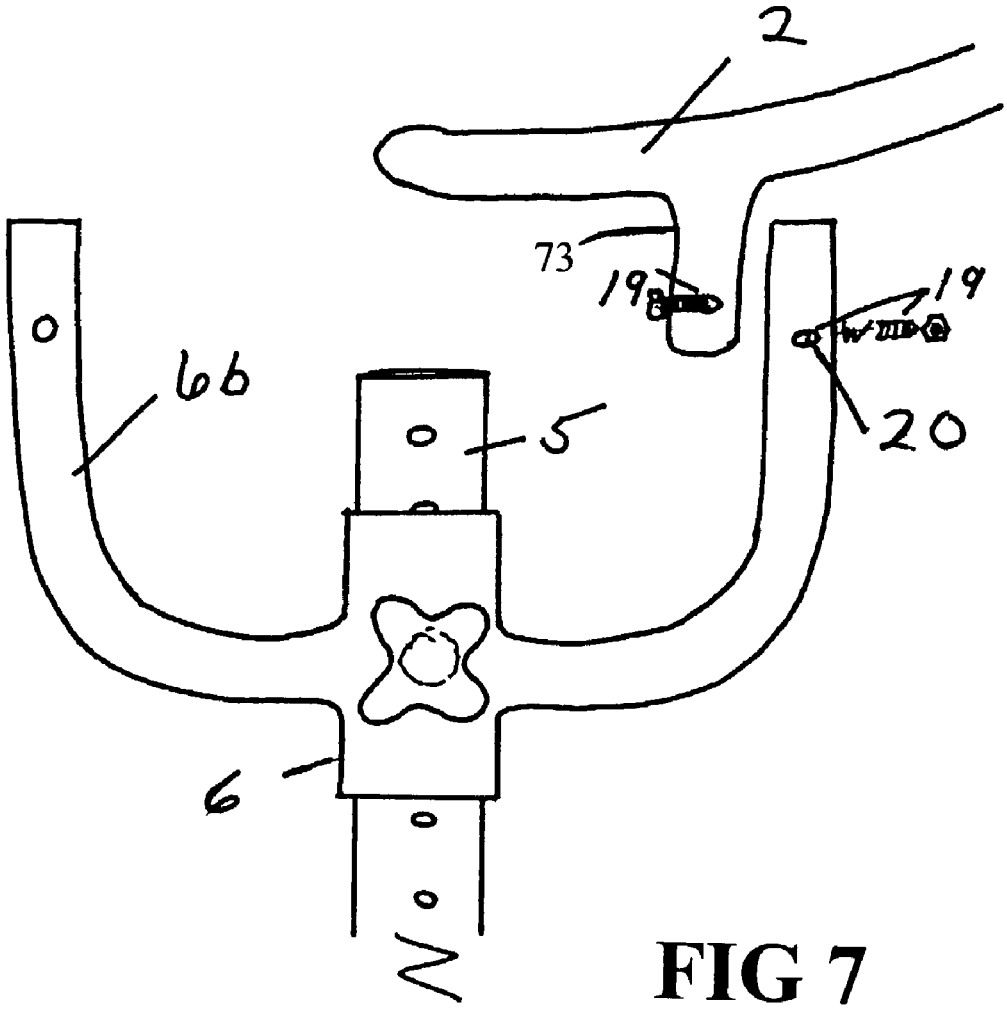
FIG. 7 is a side view showing the double rail support base configuration for the outer weight-bearing support.

FIG. 7 shows the double rail 6*b* support base configuration for the outer weight-bearing support rails 2, which is used when two outer rails meet. The double rail support configuration also takes advantage of a choice of fasteners including, but not limited to, bolts and nuts 19 or spring loaded locking pins. The double rail support configuration is always involved when the rail being secured is a gate rail. In the gate configuration, one upper extension of the vertically adjustable collar is adapted to hold the hardware for an adjustable locking hub with rotary bearing that provides positive gate locking at 10 degree increments of swing (FIGS. 8–9).

Figures 8, 9, 10:
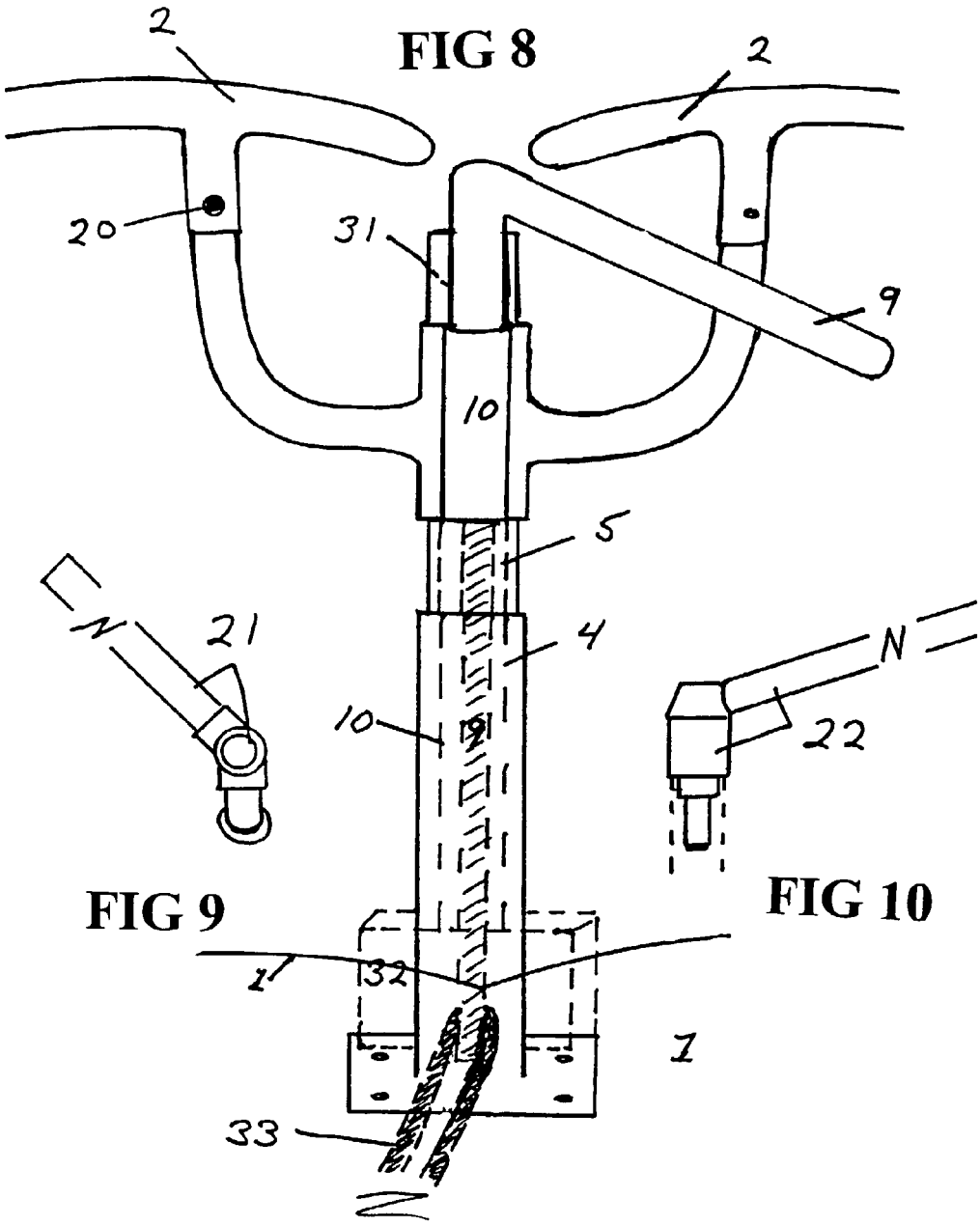
FIG. 8 is a side view showing the double rail support base with optional swing arm.
FIG. 9 is a top view of the optional manual swing arm rotation device.
FIG. 10 is a side view showing an alternate manual swing arm rotation device.

FIG. 8 shows the double rail support base with optional swing arm 9 used for the two midpoint support bases which mark the midpoint between the two circular halves of the figure-eight configured rail support. A sleeve 10 laterally welded and attached to the vertically sliding sleeve 6 holds the mechanisms for rotation control devices 21, 22, or 32. Other rotating devices may also be used. In particular, the vertical sleeve 10 is configured to accept hardware for optional manual or motorized swing of the rail extensions swing arms 9.

FIG. 9 shows a top view of one possible manual swing arm 9 rotation device. An adjustable locking hub 21 with a rotary bearing provides positive locking at 10 degree increments of swing.

FIG. 10 shows an alternate manual swing arm 9 rotation device that uses a safety tension lever 22, which engages and locks with downward pressure on the top or on arm 9, but is otherwise free to swing arm 9 when released.

Figure 11:
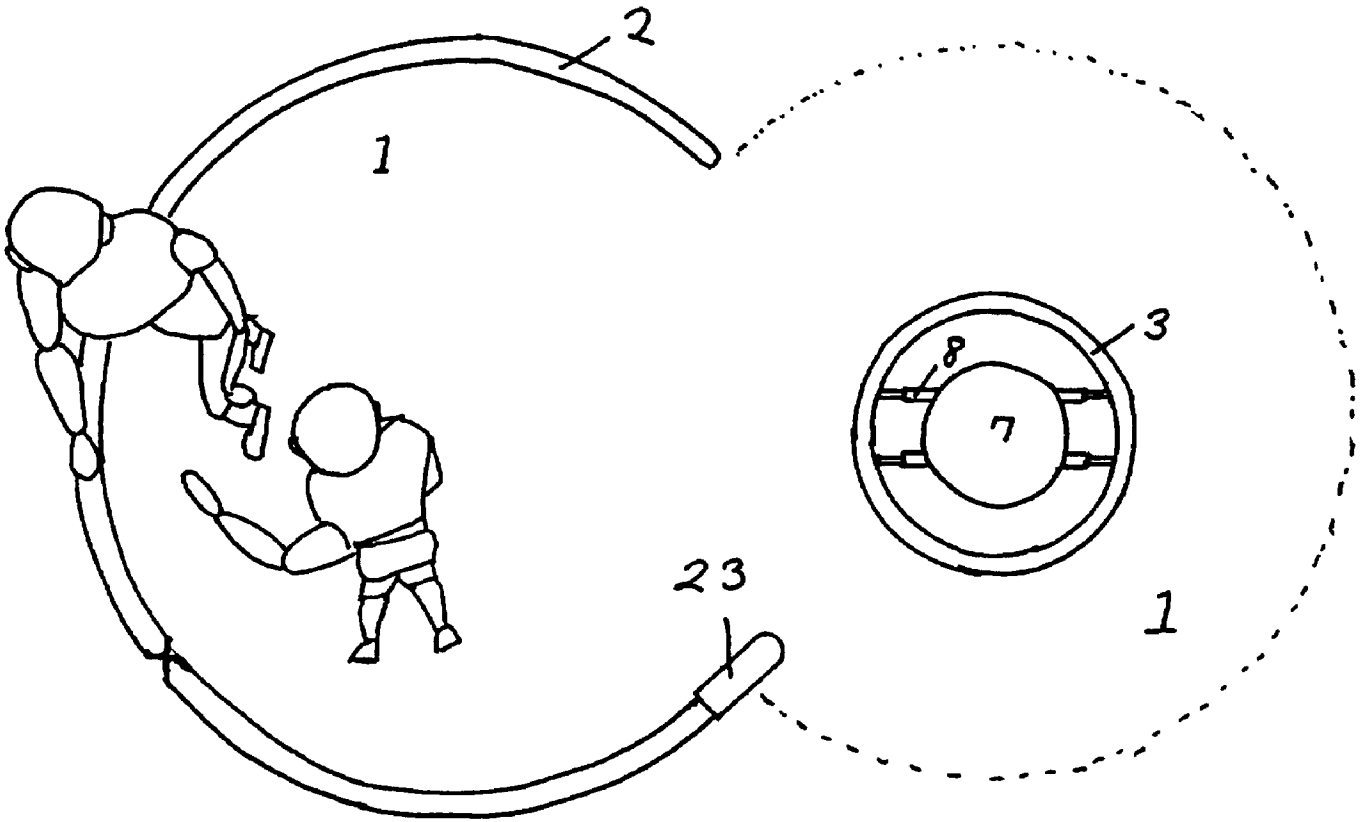
FIG. 11 is a top view of the therapeutic and exercise ambulation application as shown in FIG. 1, detailing a special needs application of the present invention.

FIG. 11 shows a special needs application of the invention where use of one outer rail 2 and one inner rail 3 weight-bearing circular supports are used. The configuration might be preferred in cases such as stroke rehabilitation, or where a therapist might prefer more open walking space to directly assist the user. In configurations where just one outer support rail is being used, an optional straight rail extension 23 may be used instead of the optional swing arm 9. The straight rail extension 23 would be used very early in therapeutic ambulation practice, when the user may still experience balance and stability insecurity or has not yet increased gait stride to allow for a normal reach between an outer rail 2 and an inner rail 3.

Figure 12:
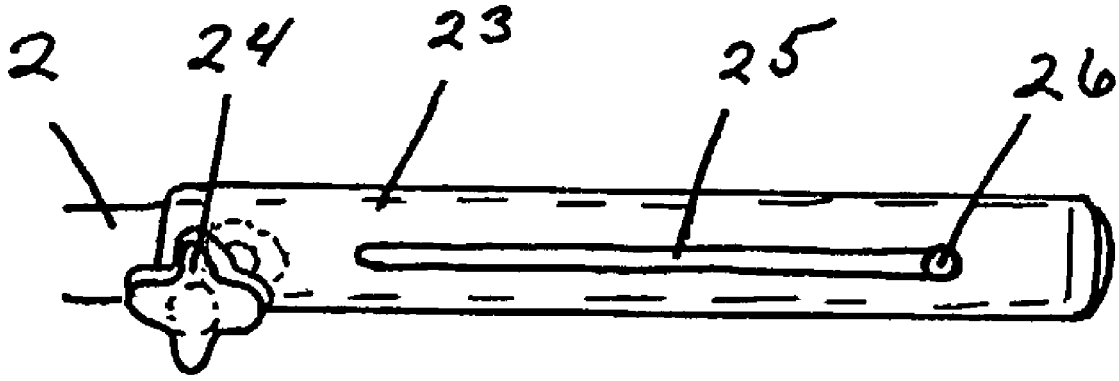
FIG. 12 is a bottom view of the optional support rail extension.

FIG. 12 shows the underside of the optional support rail extension 23. A sliding sleeve 23 that is secured to an end of the outer rail 2 with a screw knob 24, and the sleeve's extension range is limited by a groove 25 in the sleeve and a set screw 26 extending from the rail 2.

Figure 13:
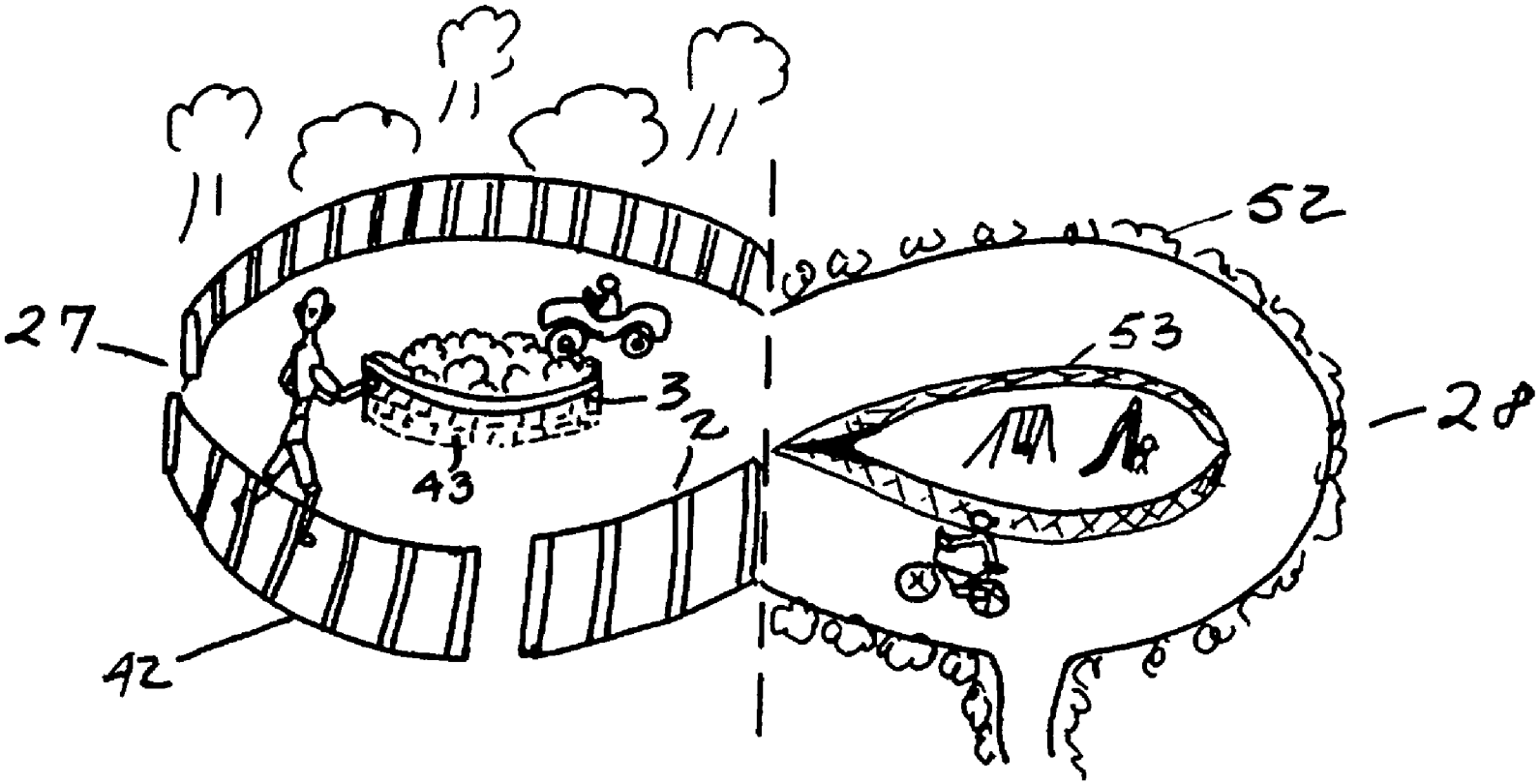
FIG. 13 is a detail showing two multi-use applications of the invention and method for indoor or outdoor use.

FIG. 13 shows two multi-use applications of the invention and methods for indoor or outdoor use that require a somewhat larger use of space and a slightly more oval configuration of the two mirror-imaged halves of the figure-eight configured surface or track. The application 27 shown on the left of the drawing makes use of weight-bearing rails 2 and 3 on laterally confining structures, 42, 43, which may be both functional in application and decorative in the environment. The application 28 shown on the right of the drawing makes use of laterally confining and defining boundaries 52, 53 without confining structures.

Figure 14:
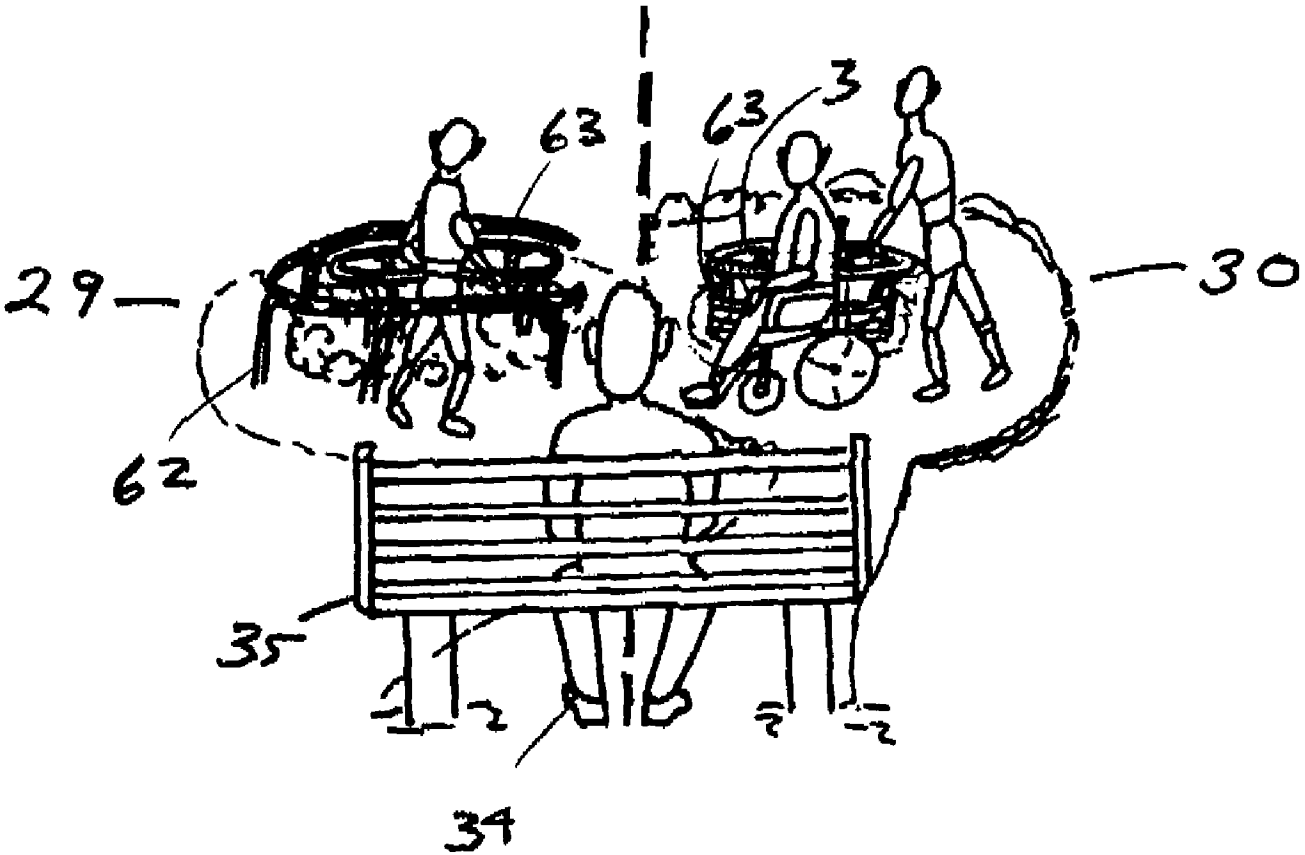
FIG. 14 is a detail showing two multi-use applications of the invention and method for indoor or outdoor use.

FIG. 14 shows two multi-use applications of the invention and methods for indoor or outdoor use that require a somewhat smaller use of space and a slightly more round configuration of the two mirror-imaged halves of the figure-eight configured surface or track. The application 29 shown on the left of the drawing makes use of generally parallel weight-bearing rails 2 and 3 on laterally confining structures 63, 63, which may be both functional in application and decorative in the environment. The application 30 shown on the right of the drawing makes use of only two inner weight-bearing rails on laterally confining structures 63, with the outer lateral boundary not including a confining structure. FIG. 14 includes an illustration of a person 34 sitting on a park bench 35 to show one configuration of the proper placement of a point of sensory focus.

While the invention has been described with reference to specific embodiments, modifications and variations of the invention may be constructed without departing from the scope of the invention, which is defined in the following claims.

I claim:

1. Therapeutic integration walking track apparatus comprising a flat therapeutic integration walking track for human sensory-motor exercise, the walking track, having a flat continuous ambulation walking surface, the walking track having a figure-eight configuration, the walking track having opposite outer and inner boundaries and the walking track having walking track borders along the opposite outer and inner boundaries of the walking surface, the walking track borders delineating the walking track for human sensory-motor exercise, the walking track and the walking track borders providing a guide for walking and therapeutic integration of motor, sensory and cognitive functions to walkers on the walking track.

2. The apparatus of claim 1, wherein the walking track borders further comprise one or more curved rails and supports connected to the rails for supporting the rails above boundaries of the track.

3. The apparatus of claim 2, wherein the rails and the supports are guiding rails.

4. The apparatus of claim 2, wherein the rails and the supports are weight-bearing supporting rails.

5. The apparatus of claim 2, wherein the supports are posts connected to the track.

6. The apparatus of claim 2, wherein the supports are posts positioned around the track.

7. The apparatus of claim 2, wherein the supports are posts positioned inside the track and wherein the rails extend outward from the posts.

8. The apparatus of claim 1, wherein the borders are within the track and on outsides of the track for delineating a figure-eight track with interior open areas.

9. The apparatus of claim 8, wherein the borders comprise low guides.

10. The apparatus of claim 8, wherein the borders comprise upper rails supported on posts along outsides and inner sides of the track.

11. The apparatus of claim 8, wherein the borders comprise combinations of lower guides and upper level rails positioned on supports.

12. The apparatus of claim 11, wherein the upper level rails are positioned on the supports along outsides of the track, and the low guides are positioned within the track.

13. The apparatus of claim 11, wherein the upper level rails are positioned on the supports within the track and the low guides are positioned along outsides of the track.

14. The apparatus of claim 11, wherein the upper level rails and the supports are weight-bearing.

15. The apparatus of claim 1, further comprising a point of focus positioned outside of the track.

16. The apparatus of claim 15, wherein the point of focus is positioned near a plane perpendicular to the track at a midpoint of the track.

17. The apparatus of claim 16, wherein the track is made of two annular curves which are joined linearly and wherein the plane passes through the linear joining of the annular curves.

18. The apparatus of claim 15, wherein the point of focus provides visual and audible stimulations.

19. The apparatus of claim 1, further comprising posts mounted near the track borders and weight-bearing rails connected to the posts.

20. The apparatus of claim 19, wherein at least some of the posts and the rails along the outer boundaries of the track are swinging and gates to the track.

21. The apparatus of claim 20, wherein at least some portions of the rail are moveable gates admitting persons to the track.

22. The apparatus of claim 20, wherein the gates are provided at intersections of the rails along outer boarders of the track and wherein the gates extend inward allowing persons using the track to move to opposite sections of the track.

23. The apparatus of claim 22, wherein the gates comprise first and second inward extending gates.

24. The apparatus of claim 23, wherein the first and second gates are interconnected for opposite swinging for providing guides for moving from one section of the track to another section of the track.

25. The apparatus of claim 24, wherein the interconnection comprises a flexible belt connected to pulleys on the gates.

26. The apparatus of claim 25, further comprising a motor connected to one of the pulleys and a switch connected to the motor for starting the motor and changing position of the gates.

27. The apparatus of claim 26, wherein the gates move in fixed increments and fix in position upon downward force on the gates.

28. The apparatus of claim 1, wherein at least one of the borders further comprises tubular support columns fixed to bases, tubular adjustable height columns slideably mounted in the support columns and extensions connected to the adjustable height columns and hand rails connected to the extensions.

29. The apparatus of claim 28, rotatable gate mounts mounted on the adjustable support columns and gate arms extending from the rotatable gate mounts.

30. The apparatus of claim 28, further comprising channel bars connected to the extensions and adjustable sliding bars connected to the channel bars and circular inner rails connected to the sliding bars for providing inner hand holds.

31. A therapeutic integration walking method comprising providing a therapeutic integration walking track for continuous sensory-motor exercise, providing a walking surface on the walking track, providing a figure-eight walking track configuration on the walking track, providing opposite elongated outer and inner boundaries on the walking track, providing walking track borders along the boundaries and above the walking surface, delineating the track with the borders walking on the track, using the borders as guides and practicing walking and therapeutic integration of motor, sensory and cognitive functions while walking on the walking track.

32. The method of claim 31, wherein the providing walking track borders further comprises providing one or more curved rails and providing supports connected to the rails for supporting the rails above the boundaries edges of the track.

33. The method of claim 32, wherein the providing the rails comprises providing guiding rails.

34. The method of claim 32, wherein the providing the rails and the supports comprises providing weight-bearing supporting rails.

35. The method of claim 32, wherein the providing the supports comprises providing posts connected to the track.

36. The method of claim 32, wherein the providing the supports comprises providing posts positioned around the track.

37. The method of claim 32, wherein the providing the supports comprises providing posts positioned inside the track and extending the rails outward from the posts.

38. The method of claim 31, wherein providing the borders comprises providing the borders within the track and on the outer boundaries of the track for delineating a figure-eight track with interior open areas.

39. The method of claim 38, wherein the providing the borders comprise providing low guides.

40. The method of claim 38, wherein the providing the borders comprises providing upper rails and supporting the upper rails on posts along outsides and sides of the track.

41. The method of claim 38, wherein the providing the borders comprises providing separate combinations of lower guides and upper level rails positioned on supports.

42. The method of claim 41, wherein the providing the upper level rails comprises positioning the rails on the supports along outsides of the track and positioning the low guides within the track.

43. The method of claim 41, wherein the providing the upper level rails comprises positioning the rails on the supports within the track and positioning the low guides along outsides of the track.

44. The method of claim 41, wherein the providing the upper level rails and the supports comprises providing weight-bearing upper rails and supports.

45. The method of claim 31, further comprising providing a point of focus positioned outside of the track near a plane perpendicular to the track at a midpoint of the track.

46. The method of claim 31, further comprising providing posts mounted near the track borders and providing weight-bearing rails connected to the posts.

47. The method of claim 46, further comprising interconnecting at least some of the posts and the rails along outer borders of the track as swinging gates to the track.

48. The method of claim 47, further comprising providing at least some portions of the rails as moveable, and admitting walkers to the track.

49. The method of claim 47, wherein the providing the gates comprises providing at least one of the gates at an intersection of the rails along outer boarders of the track and wherein the at least one of the gates extends inward, and admitting persons using the track to opposite sections of the track.

50. The method of claim 49, wherein the providing of at least one of the gates comprise providing first and second inward extending gates.

51. The method of claim 50, wherein the providing the first and second gates further comprise interconnecting for opposite swinging thereby providing guides for moving from one section of the track to another section of the track.

52. The method of claim 51, wherein the interconnecting comprises providing a flexible belt or chain connected to pulleys or gears on the gates.

53. The method of claim 52, further comprising providing a motor connected to one of the pulleys or gears and providing a switch connected to the motor for starting the motor and changing positions of the gates.

54. A physical and cognitive training method comprising walking on connected loops of a figure-eight therapeutic integration walking track while being guided by borders of the walking track, while focusing on an off track object and while turning and rotating for remaining within the borders of the walking track while continuing focusing adapted for the practice of walking and the therapeutic integration of motor, sensory and cognitive functions.

55. The method of claim 54, further comprising using hand rails along one or more borders of the track.

56. The method of claim 54, further comprising using hand rails along outer borders of the track and moving gates in the handrails for entering and leaving the track.

57. The method of claim 53, further comprising using inner and outer hand rails along inner and outer borders of the track and oppositely moving gates connected to supports for the outer hand rails when crossing between the loops of the track.

58. The method of claim 57, wherein the moving gates further comprise connecting the gates beneath the track with sprockets and a belt for the oppositely moving of the gates.

59. The method of claim 58, further comprising driving the sprockets and belt with a motor for changing positions of the gates.

60. A therapeutic and exercise ambulation figure eight sensory walking track and handrail apparatus for human sensory-motor exercise, therapeutic integration and assistive ambulation, said track comprising:

a flat walking track surface, said track surface comprising two annular curves joined linearly and configured into a continuous figure-eight pathway, said track further having opposite outer and inner laterally defining boundaries, track borders for providing a guide for walking, said borders positioned along said outer and inner boundaries for delineating a figure-eight track with interior open areas, one or more posts mounted near said track borders and weight-bearing rails connected to said posts, a point of sensory focus for visual and auditory focus, said point positioned outside of said track, whereby said track and handrail apparatus automatically engage bilateral neural priming and reflex development/recovery while walking on the figure eight track and said track and handrail continuously facilitate retraining of the natural bilateral shifts that occur during walking demands.

61. A figure eight sensory walking method for ambulation and sensory motor integration practice, said method comprising the steps of:

providing a figure eight sensory walking track for continuous sensory-motor exercises and therapeutic integration, providing a walking surface on the walking track where said track has a figure-eight configuration, providing opposite outer and inner laterally defining boundaries on said track, providing track borders along said boundaries, where said borders include one or more curved rails and providing supports connected to said rails for supporting said rails above edges of said track, delineating the track with said borders, using the borders as guides for practicing walking, continuously circling said figure-eight track in a clockwise and counterclockwise direction for a specified length of time to provide a walker with symmetrical usages of both lateral halves of a user's body, providing a point of sensory focus for the user while walking said track, thereby equally training lateral halves of a users body and bilateral motor reflexes such as neck turning and eye tracking, and including full range of torso rotation, visual and auditory sensory attention toward the designated point of sensory focus and cognitive skills.

62. A physical and cognitive sensory walking training method for use on a figure-eight track comprising the steps of:

walking on connected loops of a figure-eight therapeutic integration walking track, guiding a user using track borders while walking on said track, focusing on an off track object while walking, turning and rotating a user's body while being guided within track borders and while continuously focusing on said off track object, practicing walking and practicing the integration of motor, sensory, and cognitive functions, using hand rails along one or more borders of said track, moving gates in said handrails for entering and leaving said track.

* * * * *